US005818798A

United States Patent [19]

Luchun

[11] Patent Number: 5,818,798

[45] Date of Patent: Oct. 6, 1998

[54] TIMEPIECE WITH INTEGRAL ALPHANUMERIC DISPLAY

[75] Inventor: Philip M. Luchun, Brooklyn, N.Y.

[73] Assignee: Howard Zaretsky, Herzelia, Israel

[21] Appl. No.: 634,947

[22] Filed: Apr. 19, 1996

[51] Int. Cl.[6] ..... G04C 17/00

[52] U.S. Cl. ..... 368/281; 368/241; 368/82

[58] Field of Search ..... 368/241, 82, 281, 368/282

[56] References Cited

U.S. PATENT DOCUMENTS

| | | | |
|---|---|---|---|
| 4,041,692 | 8/1977 | Marshino | 368/82 |
| 4,068,465 | 1/1978 | Bacon | 368/188 |
| 4,803,672 | 2/1989 | Zang | 368/241 |
| 4,920,524 | 4/1990 | Kotob | 368/240 |

*Primary Examiner*—Bernard Roskoski
*Attorney, Agent, or Firm*—Howard Zaretsky

[57] ABSTRACT

A timepiece having a novel display with an integral alphanumeric display is described. The display includes alternating light and dark bands to assist in the determination by a user of the current time. The display includes two columns of a dozen hourly indicators each for indicating the current hour. The left column represents AM hours and the right column represents PM hours. In a preferred embodiment, hour indicators on the left column can be set to indicate the hours from 12:00 midnight to 11:59 AM and hour indicators on the right column can be set to indicate the hours from 12:00 in the afternoon to 11:59 PM. In another preferred embodiment, the hour indicators on the left column represent the hours from 1:00 AM to 12:59 PM and the hour indicators on the right column represent the hours form 1:00 PM to 12:59 AM. Located around the perimeter of the display is a ring of sixty minute indicators. The minute indicators arc spaced equally around the ring so as to allow a user to discern the current minute within the hour. The timepiece includes a message receiver for decoding conventional paging protocols received through an RF antenna. Received messages can be displayed within the bands as either light or dark characters.

16 Claims, 4 Drawing Sheets

TIMEPIECE WITH INTEGRAL ALPHANUMERIC DISPLAY

FIELD OF THE INVENTION

The present invention relates to timepieces and more particularly to timepieces integrating display means with a multi-line alphanumeric display.

BACKGROUND OF THE INVENTION

Currently, most of the world is undergoing a communications revolution. More now than ever before people are able to communicate with who they want and when they want. Some of the more ubiquitous communication devices available on the market today include items such as cellular telephones, beepers (including both one way and two way pagers), cordless telephones, two way radios, etc. An underlying trend associated with all types of modern communication equipment is that the size of the equipment keeps getting smaller and smaller. In the beeper field, for example, the trend is to produce smaller and smaller units while at the same time increasing the functionality with each new model.

As a byproduct of the recent explosion in the main stream use of communication equipment such as cellular telephones and beepers, many people find themselves carrying multiple pieces of communications gear. Depending on one's needs, one can easily find themselves strapped with lugging around two or three items, such as a beeper, cellular telephone, etc. Notwithstanding the trend of producing smaller and lighter equipment, one can quickly get bogged down with multiple pieces of hardware.

SUMMARY OF THE INVENTION

Accordingly, it is an object of the present invention to provide an improved timepiece and associated display that integrates a messaging device into a timepiece.

It is another object of the present invention to provide a timepiece display that functions to display one or more lines of text to a user simultaneously while indicating the time of day.

Thus, there is provided in accordance with a preferred embodiment of the present invention, a timepiece for displaying messages, comprising clock circuitry for maintaining the time of day, and a circularly shaped display coupled to the clock circuitry, the clock circuitry communicating the time of day to the display on a periodic basis, the display comprising an outer ring having a left side and a right side, the outer ring located on an outer edge of the display, a plurality of bands extending from the left side of the outer ring to the right side of the outer ring, a plurality of hour indicators positioned on the display as a first and a second column each containing an equal number of the hour indicators, one of the hour indicators being illuminated at any one time to denote a particular hour of the day, each of the bands containing two of the hour indicators, a plurality of minute indicators positioned on the outer ring such that each minute indicator is equally spaced apart from one another so as to make possible, by a user, the indication of the particular minute of the current hour.

The plurality of bands of the timepiece comprise a plurality of light bands extending from the left side of the outer ring to the right side of the outer ring, and a plurality of dark bands extending from the left side of the outer ring to the right side of the outer ring, the plurality of light bands and the plurality of dark bands arranged in an alternating fashion on the display.

The timepiece also includes a messaging receiver for receiving messages transmitted utilizing a one-way paging protocol, and display circuitry coupled to the messaging receiver, the display circuitry controlling the presentation of output from the clock circuitry and the messaging receiver on the display, the messages presented on the plurality of bands on the display.

In addition, the display circuitry is operative to blank the display of the time of day while displaying the received messages, the plurality of hour and minute indicators comprise light emitting diodes (LEDs).

BRIEF DESCRIPTION OF THE DRAWINGS

The invention is herein described, by way of example only, with reference to the accompanying drawings, wherein.

DETAILED DESCRIPTION OF THE INVENTION

Figure 1:
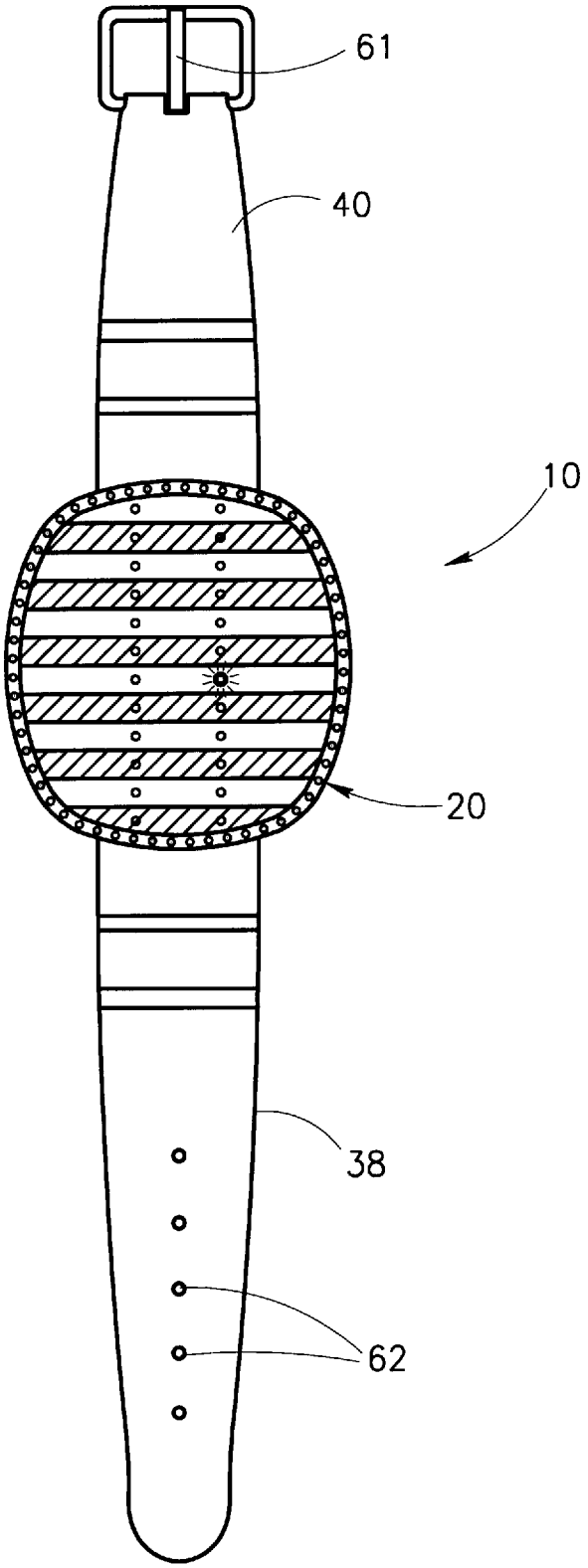
FIG. 1 is a top plan perspective view illustrating a timepiece constructed in accordance with a preferred embodiment of the present invention.

A top plan perspective view of a timepiece, generally referenced 10, constructed in accordance with a preferred embodiment of the present invention is illustrated in FIG. 1. Timepiece 10 comprises a display 20, a watch band consisting of a top band portion 40 and a bottom band portion 38 and a conventional time keeping mechanism (not shown) that is integral with display portion 20. Movably connected to top band portion 40 is a fastener 61 which normally mates with one of the holes 62 formed in the lower section of bottom band portion 38.

Figure 2:
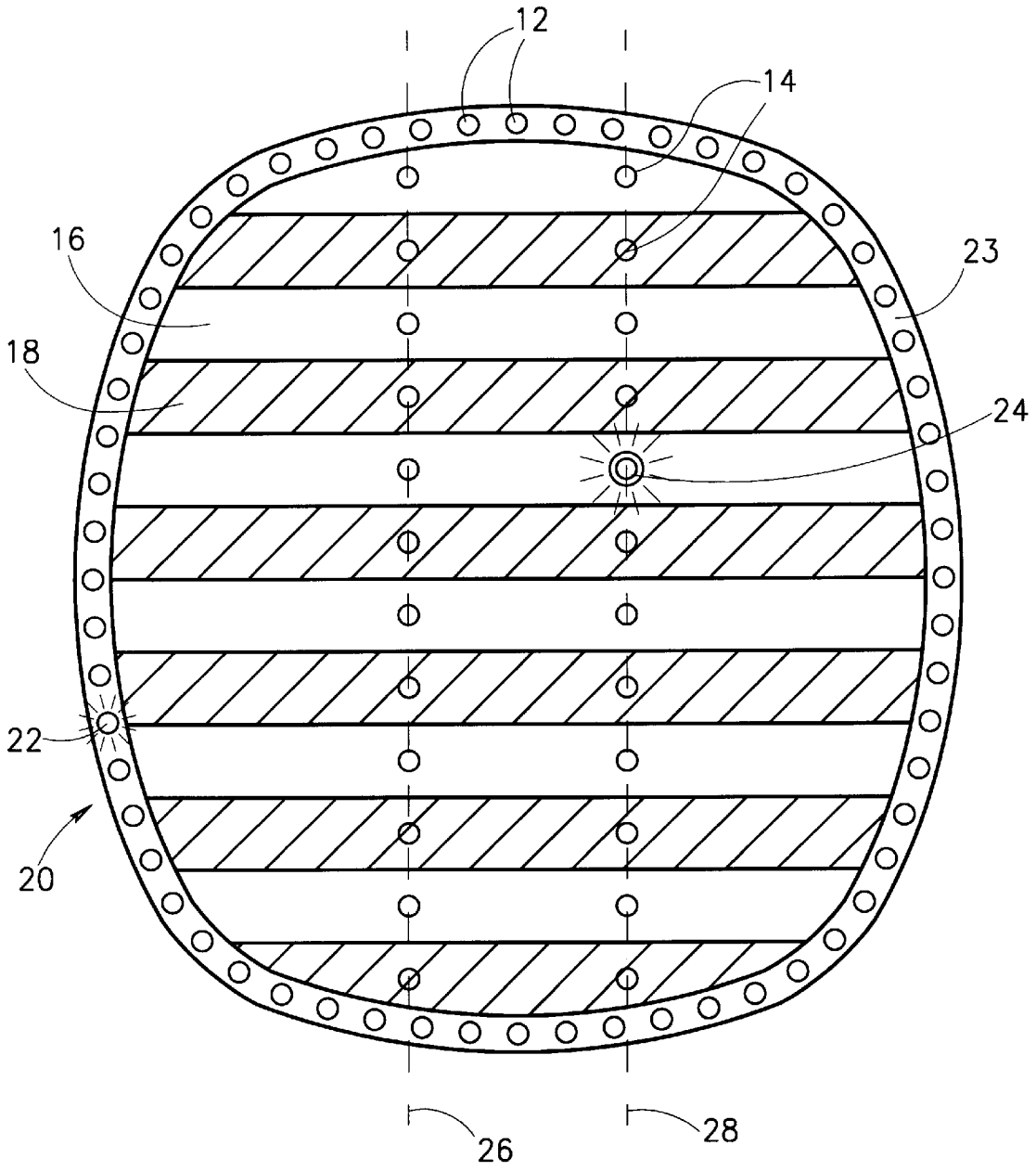
FIG. 2 is a detailed top plan view illustrating the display portion of the timepiece shown in FIG. 1

The novel features of the present invention lie in its display portion 20 which will now be described in more detail. A detailed top plan view illustrating display portion 20 of timepiece 10 is shown in FIG. 2. Display 20 has a circular shape generally similar to display shapes of conventional timepieces, however, the display of the timepiece of the present invention has been specially tailored to function as an alphanumeric display for receiving messages. In addition, a novel way of displaying the time of day is also incorporated into timepiece 10.

Display 20 comprises a circularly shaped outer ring 23 having sixty minute indicators 12 positioned uniformly around outer ring 23. In timepiece 10, the conventional minute hand is replaced with a set of sixty minute indicators 12 for designating the current minute. The sixty minute indicators 12 can be any suitable type of indicator such as, but not limited to, light emitting diodes (LEDs), liquid crystal display (LCD), electroluminescent or electrophospherent. The sixty minute indicators 12 are positioned around outer ring 23 so as to indicate the zero to fifty nine minutes of an hour.

Display 20 also comprises alternating light and dark bands 16, 18, respectively. The example shown in FIG. 2 illustrates alternating light/dark bands, however, alternating dark/light band work equally as well. Display 20 comprises 12 rows of bands 16, 18, with all bands having uniform width. The length of each band extending from one inner edge of outer ring 23 to the opposite inner edge of outer ring 23.

In addition, display 20 comprises hour indicators 14 which function to indicate the current hour, thus replacing the hour hand of a conventional timepiece. Hour indicators 14 may be any suitable type indicator such as those described above in connection with minute indicators 12. Hour indicators 14 are positioned in display 20 as two columns, 26, 28 of twelve indicators each, representing AM and PM times, respectively. Hour indicator column 26 is situated, in a preferred embodiment, approximately one third of the distance inward from the left portion of outer ring 23. Hour indicator column 28 is situated, in a preferred embodiment, approximately one third of the distance inward from the right portion of outer ring 23. In addition, each band 16, 18 has situated in it two hour indicators, one for AM hours and one for PM hours. In a preferred embodiment, the hour indicator in the top light band in column 26, represents 12:00 PM midnight to 12:59 AM. The hour indicator in the topmost dark band in column 26 represents 1:00 to 1:59 AM. The bottom dark band in column 26 represents 11:00 AM to 11:59 AM. Similarly, the hour indicator in the top light band in column 28, represents 12:00 to 12:59 PM. The hour indicator in the topmost dark band in column 28 represents 1:00 to 1:59 PM. The bottom dark band in column 28 represents 1:00 PM to 11:59 PM.

In another preferred embodiment, the hour indicators in columns 26 and 28 are shifted by one hour from the embodiment described above. For example, the hour indicator in the top light band in column 26, represents 1:00 AM to 1:59 AM. The hour indicator in the topmost dark band in column 26 represents 2:00 to 2:59 AM. The bottom dark band in column 26 represents 12:00 AM to 12:59 PM. Similarly, the hour indicator in the top light band in column 28, represents 1:00 PM to 1:59 PM. The hour indicator in the topmost dark band in column 28 represents 2:00 PM to 2:59 PM. The bottom dark band in column 28 represents 12:00 PM midnight to 12:59 AM. This display embodiment may be found easier to read and comprehend at a quick glance by user due to the band row number corresponding to the hour of the day.

During each hour, the minutes are indicated by minute indicators 12. The transition from one hour indicator to the next occurs at the end of the $59^{th}$ minute. The transition from the 11:00 AM to 12:00 PM hour indicator in the bottom dark band in column 26 to the 12:00 PM to 1:00 PM hour indicator in the light top band in column 28 occurs the moment the $59^{th}$ minute finishes and the $0^{th}$ or $60^{th}$ minute indicator is illuminated. The same is true for the transition from the 11:00 PM to 12:00 AM hour indicator in the bottom dark band in column 28 to the 12:00 AM to 1:00 AM hour indicator in the light top band in column 26. As an example of indicating time using display 20, hour indicator 24 and minute indicator 22 are shown illuminated. The time shown is 4:40 PM, since the fifth band (a light band) down indicator 22 is at the $40^{th}$ minute position.

Figure 3:
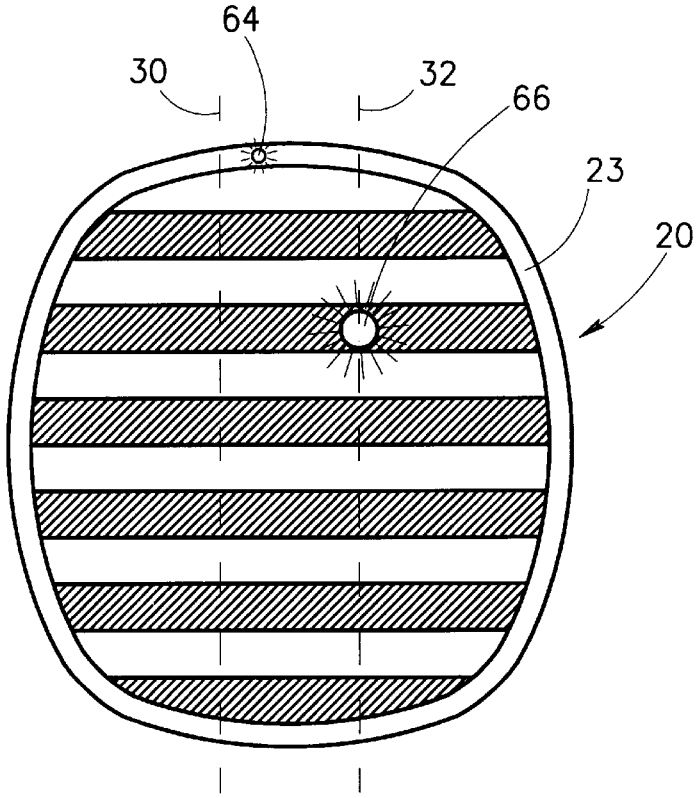
FIG. 3 is a top plan view illustrating one of the dark band hours indicators being illuminated on the display portion of the timepiece.

In an alternative embodiment, the hour indicators within each band also alternate between light and dark indicators. Light bands would contain dark hour indicators and dark bands would contain light hour indicators. This embodiment can be easily implemented if the display utilizes an LCD screen for its surface. Light and dark areas can easily be generated and switched using an LCD panel. A top plan view illustrating one of the dark band hour indicators being illuminated on display portion 20 of the timepiece, which is implemented using an LCD panel, is shown in FIG. 3. Display 20 comprises an LCD panel suitably designed to have dark indicators on light bands and light indicators on dark bands in both columns 30, 32. Outer ring 23 may be either dark with light minute indicators or light with dark minute indicators. The time shown in the example in FIG. 3 is 3:58 PM as indicated by hour indicator 66 and minute indicator 64.

Figure 4:
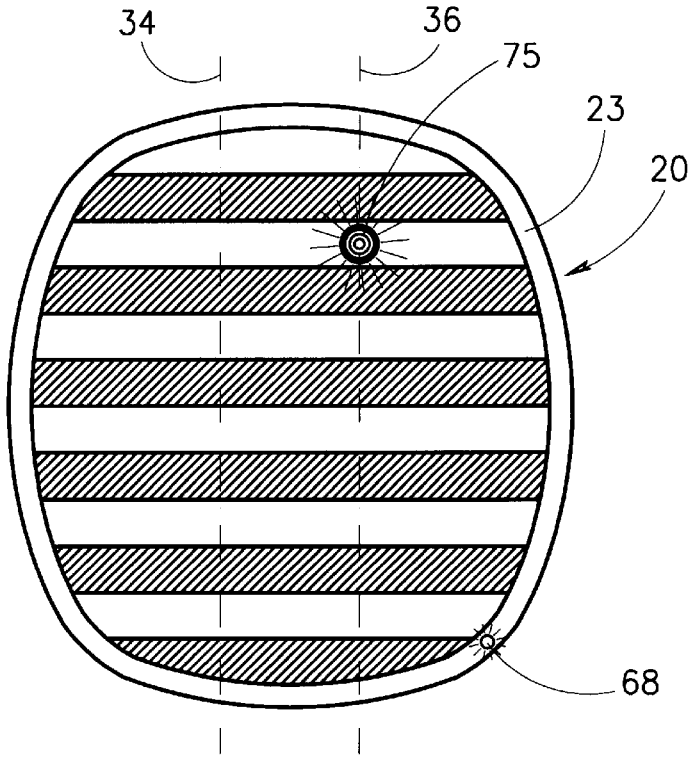
FIG. 4 is a top plan view illustrating one of the light band hours indications being illuminated on the display portion of the timepiece.

Similarly, FIG. 4 shows a top plan view illustrating one of the light band hour indications being illuminated on display portion 20 of the timepiece. In this example, the hours in columns 34, 36 are indicated on light bands using dark hour indicators. The time shown in the example in FIG. 4 is 2:25 PM as indicated by hour indicator 70 and minute indicator 68.

Figure 5:
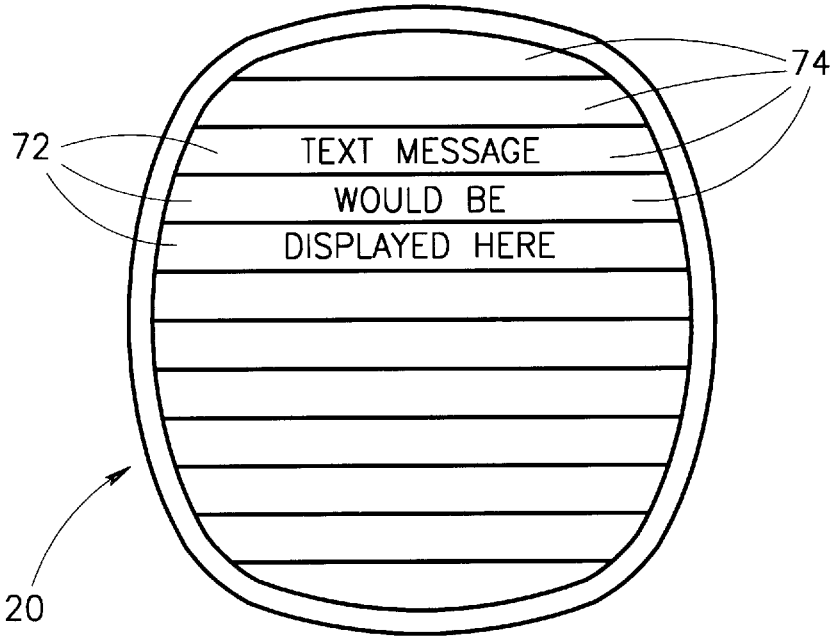
FIG. 5 is a top plan view illustrating an example alphanumeric message displayed on the display portion of the timepiece.

As discussed previously, a main object of the present invention is to integrate messaging and associated alphanumeric display capabilities into a timepiece. A top plan view illustrating such an integration of an alphanumeric message display within display portion 20 of a timepiece is shown in FIG. 5. Timepiece 10 comprises a conventional message receiver portion capable of receiving messages transmitted from messaging transmission source. The message receiver can be suitably constructed to operate with any of the currently available paging protocols such as, but not limited to, FLEX, POCSAG, or ERMES.

For displaying messages, display 20 utilizes bands 74 to display a text message received via the messaging receiver. Different alternatives of displaying a text message simultaneously with the current time can be embodied in the present invention. In a preferred embodiment, display 20 is constructed such that the display of a text message does not interfere with the current indication of time. This can be implemented utilizing an LCD panel for the surface of display 20. All the bands on the watch surface can be utilized to display text with the text to be displayed on a light band being displayed using dark characters and text to be displayed on a dark band being displayed using light characters. Alternatively, indication of current time can be momentarily suspended while messages are displayed on display 20. In this embodiment, bands 74 can be uniformly all light or dark.

Figure 6:
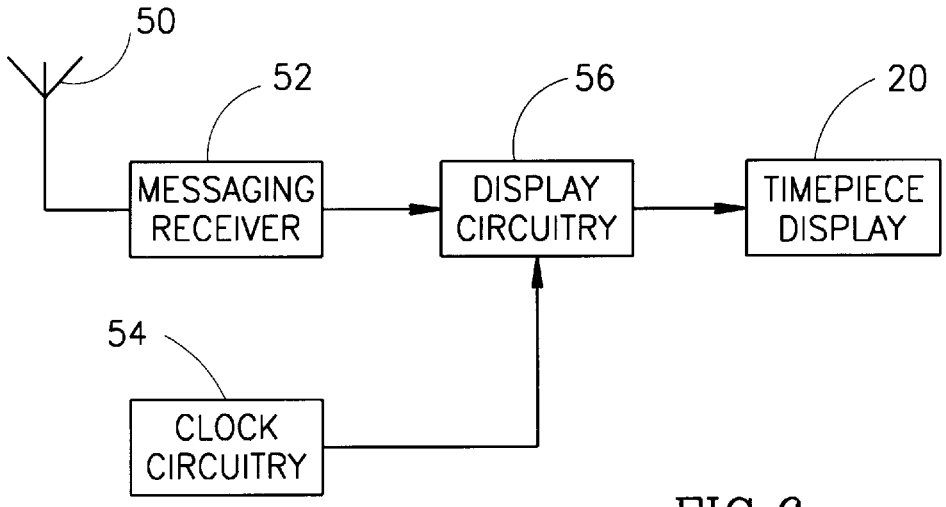
FIG. 6 is a high level block diagram illustrating the operating circuitry of the timepiece.

A high level block diagram illustrating the operating circuitry of timepiece 10 is shown in FIG. 6. The operating circuitry comprises an antenna 50 coupled to messaging receiver 52 which, in turn, is coupled to display circuitry 56. Also coupled to display circuitry is clock circuitry 54. The output of display circuitry is coupled to timepiece display 20. The operating circuitry is suitably constructed to fit within the housing of timepiece 10.

Antenna 50 is suitably constructed to receive the typically high frequency paging signals in use currently today. Messaging receiver 52, coupled to antenna 50, is constructed to receive and decode a conventional radio frequency (RF) paging protocol signal as discussed above. The output of messaging receiver 52 is coupled to display circuitry 56 which functions to control timepiece display 20. Conventional clock circuitry 54 maintains the current time and interfaces to display circuitry 56 so the current time can be display on display 20.

While the invention has been described with respect to a limited number of embodiments, it will be appreciated that many variations, modifications and other applications of the invention may be made.

What is claimed is:

1. A timepiece comprising:

clock circuitry for maintaining the time of day; and a display coupled to said clock circuitry, said clock circuitry communicating said time of day to said display on a periodic basis, said display comprising:

an outer ring having a left side and a right side, said outer ring located on an outer edge of said display;

a plurality of horizontal bands extending from said left side of said outer ring to said right side of said outer ring;

a plurality of hour indicators positioned on said display as a first vertical column and a second vertical column each containing an equal number of said hour indicators, one of said hour indicators being illuminated at any one time to denote a particular hour of the day, each of said bands containing two of said hour indicators;

a plurality of minute indicators positioned within said outer ring such that each minute indicator is spaced apart from one another so as to make possible, by a user, an indication of the minute of the current hour.

2. The timepiece according to claim 1, wherein said plurality of bands comprises:

a plurality of light bands extending from said left side of said outer ring to said right side of said outer ring, and a plurality of dark bands extending from said left side of said outer ring to said right side of said outer ring, said plurality of light bands and said plurality of dark bands arranged in an alternating fashion on said display.

3. The timepiece according to claim 1, further comprising a messaging receiver for receiving messages transmitted utilizing a one-way paging protocol; and display circuitry coupled to said messaging receiver, said display circuitry controlling the presentation of output from said clock circuitry and said messaging receiver on said display, said messages presented on said plurality of bands on said display.

4. The timepiece according to claim 3, wherein said display circuitry is operative to blank the display of said time of day while displaying said received messages.

5. The timepiece according to claim 1, wherein said plurality of hour indicators comprise light emitting diodes (LEDs).

6. The timepiece according to claim 1, wherein said plurality of minute indicators comprise light emitting diodes (LEDs).

7. A timepiece for displaying messages, comprising:

clock circuitry for maintaining the time of day;

a display coupled to said clock circuitry, said clock circuitry communicating said time of day to said display on a periodic basis, said display comprising:

an outer ring having a left side and a right side, said outer ring located on an outer edge of said display;

a plurality of horizontal bands extending from said left side of said outer ring to said right side of said outer ring;

a plurality of hour indicators positioned on said display as a first and a second vertical column each containing an equal number of said hour indicators, one of said hour indicators being illuminated at any one time to denote a particular hour of the day, each of said bands containing two of said hour indicators;

a plurality of minute indicators positioned within said outer ring such that each minute indicator is equally spaced apart from one another so as to make possible, by a user, the indication of the particular minute of the current hour;

a messaging receiver for receiving messages transmitted utilizing a one-way paging protocol; and display circuitry coupled to said messaging receiver, said display circuitry controlling the presentation of output from said clock circuitry and said messaging receiver on said display, said messages presented on said plurality of bands on said display.

8. The timepiece according to claim 7, wherein said plurality of horizontal bands comprises:

a plurality of light bands extending from said left side of said outer ring to said right side of said outer ring; and a plurality of dark bands extending from said left side of said outer ring to said right side of said outer ring, said plurality of light bands and said plurality of dark bands arranged in an alternating fashion on said display.

9. The timepiece according to claim 7, wherein said plurality of horizontal bands comprises twelve light bands.

10. The timepiece according to claim 7, wherein said plurality of minute indicators bands comprises from two to sixty minute indicators.

11. The timepiece according to claim 7, wherein said display circuitry is operative to blank the display of said time of day while displaying said received messages.

12. The timepiece according to claim 7, wherein said plurality of hour indicators comprise light emitting diodes (LEDs).

13. The timepiece according to claim 7, wherein said plurality of minute indicators comprise light emitting diodes (LEDs).

14. A timepiece, comprising:

clock circuitry for maintaining the time of day; and a display coupled to said clock circuitry, said clock circuitry communicating said time of day to said display on a periodic basis, said display comprising:

a plurality of hour indicators positioned on said display as a first vertical column and a second vertical column each containing an equal number of said hour indicators, one of said hour indicators being illuminated at any one time to denote a particular hour of the day; and a plurality of minute indicators positioned at or near the outer edge of said display such that each minute indicator is spaced apart from one another so as to make possible, by a user, an indication of the minute of the current hour.

15. The timepiece according to claim 14, wherein said plurality of hour indicators comprise light emitting diodes (LEI)s).

16. The timepiece according to claim 14, wherein said plurality of minute indicators comprise light emitting diodes (LEDs).

* * * * *